US008882065B2

(12) United States Patent
Henriott et al.

(10) Patent No.: US 8,882,065 B2
(45) Date of Patent: Nov. 11, 2014

(54) TWO PIECE TRACK ASSEMBLY

(75) Inventors: Jay M. Henriott, Jasper, IN (US); Keith E. Metcalf, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 0 days.

(21) Appl. No.: 13/454,228

(22) Filed: Apr. 24, 2012

(65) Prior Publication Data

US 2012/0273633 A1 Nov. 1, 2012

Related U.S. Application Data

(60) Provisional application No. 61/479,022, filed on Apr. 26, 2011.

(51) Int. Cl.
*A47B 96/06* (2006.01)
*A47F 5/00* (2006.01)
*E04B 2/74* (2006.01)

(52) U.S. Cl.
CPC ..... *A47B 96/067* (2013.01)
USPC ..... 248/205.1; 248/231.91; 248/225.11; 248/220.21; 248/220.31; 248/320; 248/339; 52/506.06; 52/506.08; 52/506.09; 52/506.01; 52/459; 52/461; 52/466; 52/468; 52/470; 52/460; 52/462; 52/463; 52/464; 52/506.05; 52/36.5; 160/130

(58) Field of Classification Search
USPC ..... 248/205.1, 231.91, 225.11, 235, 248/220.21, 220.31, 320, 339; 52/506.06, 52/506.08–508.09, 506.01, 459, 461, 465, 52/466, 468, 470, 462, 463, 464, 506.05, 52/36.5; 160/130
See application file for complete search history.

(56) References Cited

U.S. PATENT DOCUMENTS

| | | | | |
|---|---|---|---|---|
| 2,947,093 | A | | 8/1960 | Masters |
| 3,425,568 | A | | 2/1969 | Albright |
| 3,566,561 | A | | 3/1971 | Tozer |
| 3,593,475 | A | | 7/1971 | LaGue |
| 4,311,295 | A | * | 1/1982 | Jamar, Jr. ..... 248/222.11 |
| 4,385,850 | A | * | 5/1983 | Bobath ..... 403/205 |
| 4,513,941 | A | | 4/1985 | Yamaguchi |

(Continued)

FOREIGN PATENT DOCUMENTS

SE 7810434 4/1980

OTHER PUBLICATIONS

Krug "Virtu", Product Information Brochure, at least as early as Jan. 18, 2012.
Hon "Smartlink", Brochure and Product Information, 2010.

(Continued)

*Primary Examiner* — Christopher Garft
(74) *Attorney, Agent, or Firm* — Faegre Baker Daniels LLP

(57) ABSTRACT

A two-piece track assembly may be used in an office environment for mounting accessory components, such as work surfaces, cabinets, shelves, filing units, etc., to either a permanent building wall or to the framework of a movable office wall or office partition system. The track assembly includes a base mountable to the wall or framework via a plurality of fasteners. A track mounts to the base to cover the fasteners used to mount the base. The track also includes a relatively thinly-profiled slot into which a corresponding, relatively thinly-profiled mounting flange of an accessory component is received to mount and support the accessory component upon the track assembly. Optionally, a decorative or functional tile may be mounted to a wall or partition between a pair of track assemblies spaced vertically from one another.

24 Claims, 8 Drawing Sheets

(56) References Cited

U.S. PATENT DOCUMENTS

| | | | | |
|---|---|---|---|---|
| 4,697,365 | A | 10/1987 | Moosbrugger et al. | |
| 4,736,563 | A * | 4/1988 | Bilhorn | 52/460 |
| 4,825,601 | A | 5/1989 | Halverson | |
| 4,891,922 | A | 1/1990 | Hozer et al. | |
| 4,961,295 | A | 10/1990 | Kosch, Sr. et al. | |
| 4,986,332 | A | 1/1991 | Lanuza | |
| 5,062,246 | A | 11/1991 | Sykes | |
| 5,086,606 | A | 2/1992 | Finses | |
| 5,155,952 | A * | 10/1992 | Herwegh et al. | 52/100 |
| 5,178,353 | A * | 1/1993 | Huxtable | 248/222.52 |
| 5,184,441 | A | 2/1993 | Balfanz, Jr. | |
| 5,228,579 | A | 7/1993 | Kaufman | |
| 5,295,651 | A | 3/1994 | Baker, Jr. | |
| 5,309,686 | A | 5/1994 | Underwood et al. | |
| 5,353,571 | A | 10/1994 | Berdan et al. | |
| 5,414,967 | A | 5/1995 | Cates et al. | |
| 5,485,933 | A * | 1/1996 | Crooymans | 211/90.04 |
| 5,634,300 | A | 6/1997 | Huebner et al. | |
| 5,806,261 | A | 9/1998 | Huebner et al. | |
| 5,809,709 | A | 9/1998 | Ryan et al. | |
| 5,941,026 | A * | 8/1999 | Eisenreich et al. | 52/36.5 |
| 5,954,408 | A | 9/1999 | Bogucki | |
| 6,012,258 | A | 1/2000 | Brown et al. | |
| 6,065,262 | A | 5/2000 | Motta | |
| 6,134,845 | A | 10/2000 | Shipman et al. | |
| 6,167,676 | B1 | 1/2001 | Shipman et al. | |
| 6,349,507 | B1 | 2/2002 | Muellerleile | |
| 6,349,516 | B1 | 2/2002 | Powell et al. | |
| 6,378,255 | B1 | 4/2002 | Eich et al. | |
| 6,425,219 | B1 | 7/2002 | Barmak et al. | |
| 6,510,635 | B1 * | 1/2003 | Rudolph et al. | 40/658 |
| 6,553,731 | B2 | 4/2003 | Hsueh | |
| 6,588,165 | B1 * | 7/2003 | Wright | 52/506.05 |
| 6,631,813 | B1 | 10/2003 | Walter et al. | |
| 6,807,784 | B2 | 10/2004 | Hsueh | |
| 6,837,384 | B2 | 1/2005 | Secondino | |
| 6,883,277 | B2 | 4/2005 | Wiechecki et al. | |
| 7,086,542 | B2 | 8/2006 | Tomonari et al. | |
| 7,104,023 | B1 | 9/2006 | Holtzrager | |
| 7,122,744 | B2 | 10/2006 | Walter et al. | |
| 7,150,127 | B2 | 12/2006 | Underwood et al. | |
| 7,310,918 | B1 | 12/2007 | Reuter et al. | |
| 7,540,115 | B2 | 6/2009 | Metcalf et al. | |
| 7,581,353 | B1 | 9/2009 | Gill et al. | |
| 7,743,575 | B2 * | 6/2010 | Ito | 52/582.1 |
| 7,752,813 | B2 | 7/2010 | Picchio | |
| 7,797,901 | B2 | 9/2010 | Near | |
| 7,891,148 | B2 | 2/2011 | Underwood et al. | |
| 7,908,805 | B2 | 3/2011 | Metcalf et al. | |
| 7,921,615 | B2 | 4/2011 | Picchio | |
| 8,136,321 | B1 * | 3/2012 | Bauman | 52/506.08 |
| 8,177,311 | B2 * | 5/2012 | Apgood et al. | 312/245 |
| 2002/0053174 | A1 | 5/2002 | Barmak | |
| 2002/0112411 | A1 | 8/2002 | Gravel et al. | |
| 2005/0034378 | A1 | 2/2005 | Underwood et al. | |
| 2005/0247653 | A1 * | 11/2005 | Brooks | 211/94.01 |
| 2007/0033894 | A1 | 2/2007 | Underwood et al. | |
| 2008/0105637 | A1 * | 5/2008 | Lawson | 211/94.01 |
| 2009/0173016 | A1 | 7/2009 | Metcalf et al. | |
| 2010/0175332 | A1 | 7/2010 | Henriott | |

OTHER PUBLICATIONS

Bretford "Here" Rail System, Brochure and Product Information, Apr. 21, 2005.

Office Action dated Mar. 15, 2013 in U.S. Appl. No. 13/352,425.

Office Action dated Oct. 22, 2013 in corresponding Canadian Application No. 2,775,459.

* cited by examiner

TWO PIECE TRACK ASSEMBLY

CROSS REFERENCE TO RELATED APPLICATION

This application claims the benefit under Title 35, U.S.C. §119(e) of U.S. Provisional Patent Application Ser. No. 61/479,022, entitled TWO PIECE TRACK ASSEMBLY, filed on Apr. 26, 2011, the entire disclosure of which is expressly incorporated by reference herein.

BACKGROUND

1. Technical Field

The present disclosure relates to office furniture, and in particular to an accessory track for mounting accessory office furniture components to a permanent wall or to panels of a partition system.

2. Description of the Related Art

In an office environment, tracks are used to mount accessory components, such as work surfaces, cabinets, shelves, filing units, etc., to either a permanent wall or to the walls of an office partition system. One known track is formed as a single piece extrusion having a channel which is relatively wide in a vertical dimension. Brackets or other mounting hardware are used to mount an accessory component to the track, with the brackets or hardware separate from both the track and the accessory component.

Although the foregoing tracks have proven useful, improvements to the same are desired.

SUMMARY

The present disclosure provides a two-piece track assembly that may be used in an office environment for mounting accessory components, such as work surfaces, cabinets, shelves, filing units, etc., to either a permanent building wall or to the framework of a movable office wall or office partition system. The track assembly includes a base mountable to the wall or framework via a plurality of fasteners. A track mounts to the base to cover the fasteners used to mount the base. The track also includes a relatively thinly-profiled slot into which a corresponding, relatively thinly-profiled mounting flange of an accessory component is received to mount and support the accessory component upon the track assembly. Optionally, a decorative or functional tile may be mounted to a wall or partition between a pair of track assemblies spaced vertically from one another.

In one form thereof, the present disclosure provides a track assembly, comprising: a first component mountable to a substrate, the first component comprising: an exterior face; an upper portion including upper engagement structure; and a lower portion including lower engagement structure; and a second component mountable to the first component, the second component comprising: a body having a front body portion and a rear body portion; the front body portion including a slot having a first, horizontal slot section extending into the body from a front face of the front body portion and a second, angled slot section extending into the body from the first slot section; and the rear body portion including an upper arm and a lower arm, the upper and lower arms respectively engageable with the upper and lower engagement structures of the first component.

In another form thereof, the present disclosure provides, in combination, an accessory component comprising a mounting flange including a first, horizontal flange portion and a second, angled flange portion extending from the first flange portion; and a track assembly, comprising: a first component mountable to a vertical substrate, the first component comprising: an exterior face; an upper portion including an upper engagement structure; and a lower portion including a lower engagement structure; and a second component mountable to the first component, the second component comprising: a body having a front body portion and a rear body portion; the front body portion including a slot having a first, horizontal slot section extending into the body from a front face of the front body portion and a second, angled slot section extending into the body from the first slot section, the slot sized to receive the mounting flange; and the rear body portion including an upper arm and a lower arm, the first component mounted to the second component when the upper arm and the lower arm are engaged with the upper and lower engagement structures of the first component, respectively.

In yet another form thereof, the present disclosure provides a method of mounting a track assembly to a vertical substrate of an office system, comprising the steps of: providing a track assembly comprising a first component and a second component; mounting the first component to the vertical substrate; and pivotally mounting the second component to the first component.

BRIEF DESCRIPTION OF THE DRAWINGS

The above-mentioned and other features and advantages of this disclosure, and the manner of attaining them, will become more apparent and the invention itself will be better understood by reference to the following descriptions of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the disclosure in any manner.

DETAILED DESCRIPTION

Accessory components, such as work surfaces, cabinets, shelves, filing units, etc. are often used in office environments. The present disclosure describes a two-piece track assembly that may be used in an office environment for modular mounting of such accessory components to either a permanent building wall or to the framework of a movable office wall or office partition system. The track assembly of the present disclosure includes a base mountable to the wall or framework via a plurality of fasteners, and a track mountable to the base such that the fasteners used to mount the base are covered.

The track also includes a relatively thinly-profiled slot sized to receive a corresponding, relatively thinly-profiled mounting flange of an accessory component (as described herein). When so received, the flange and slot cooperate to mount and support the accessory component upon the track assembly. Optionally, the track assemblies may be mounted as vertically spaced pairs adapted to receive a decorative or functional tile therebetween, such that the tile covers the adjacent wall or partition.

Figure 1:
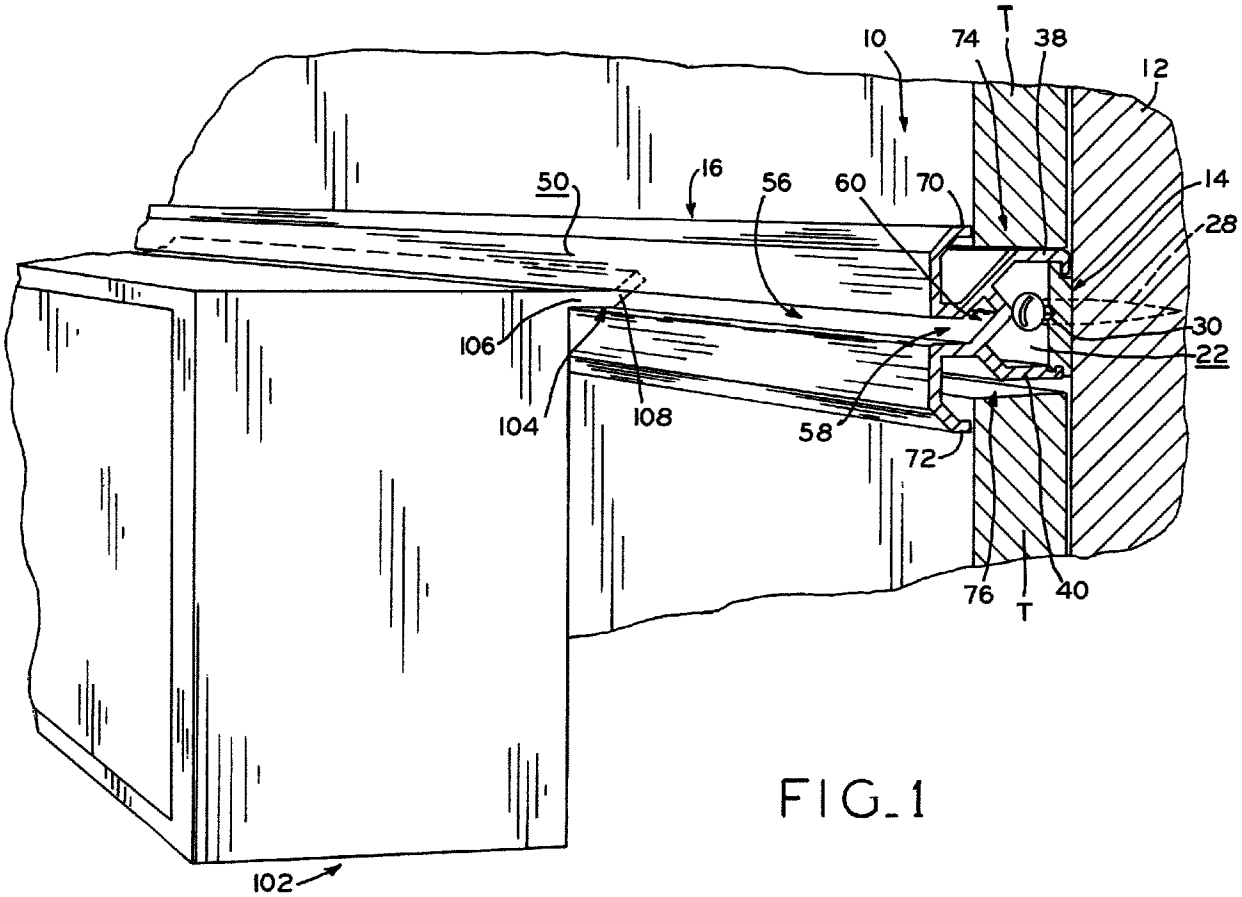
FIG. 1 is perspective view of a two piece wall track assembly of the present disclosure, illustrating a base of the track assembly attached to a wall, a track of the track assembly mounted to the base, and an accessory component mounted to the track via a mounting flange received in a slot of the track, and a pair of tiles coupled to the track.

Referring now to FIGS. 1 and 2, two-piece wall track assembly 10 is shown mounted upon substrate surface 12, which may be any substrate surface capable of providing support for track assembly 10. Exemplary substrate surfaces 12 suitable for use with track assembly 10 include permanent interior or exterior walls of a building, movable office walls such as floor-to-ceiling partition systems, and movable partition system panels of the type that do not extend completely from a floor to a ceiling.

Figure 2A:
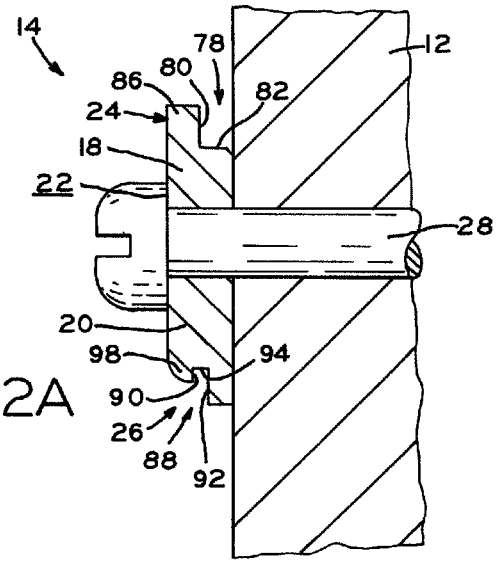
FIG. 2A is an elevation, cross-sectional view of a base of the track assembly shown in FIG. 1, in which the base portion is mounted to a substrate surface.

Two-piece track assembly 10 includes a first component, shown as base 14, and a second component, shown as track 16. As illustrated in FIG. 2A, when mounted to a vertically oriented substrate surface 12, base 14 includes a vertically oriented wall having upper portion 18 and lower portion 20 (FIG. 2A). Exterior or front face 22 of base 14 spans upper and lower portions 18 and 20 of base 14 and faces away from substrate 12 when base 14 is attached thereto as shown. Upper and lower portions 18 and 20, of the base 14 include respective upper and lower engagement structures 24, 26 respectively which cooperate with corresponding structures of track 16 to form assembly 10 as described in detail below. Base 14 is attached to substrate 12 using a plurality of fasteners 28, for example, which may be driven through a V-shaped locating indent feature 30 (FIG. 1) formed on exterior face 22 of base 14.

Figure 2B:
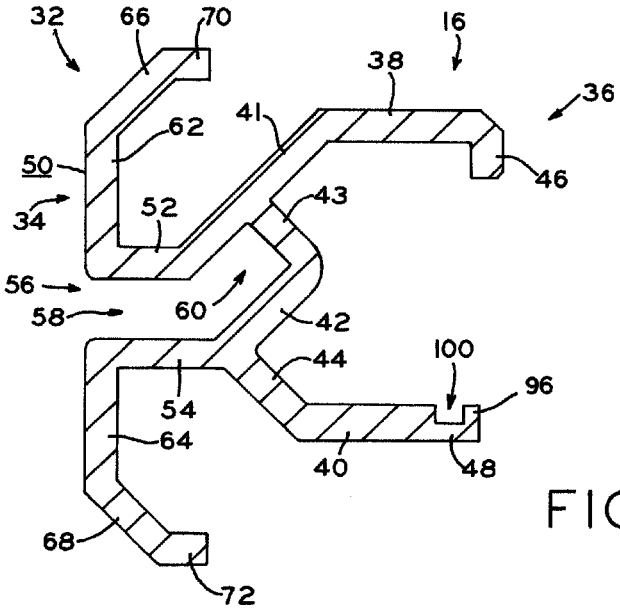
FIG. 2B is an elevation, cross-sectional view of a track of the track assembly shown in FIG. 1
Figure 2C:
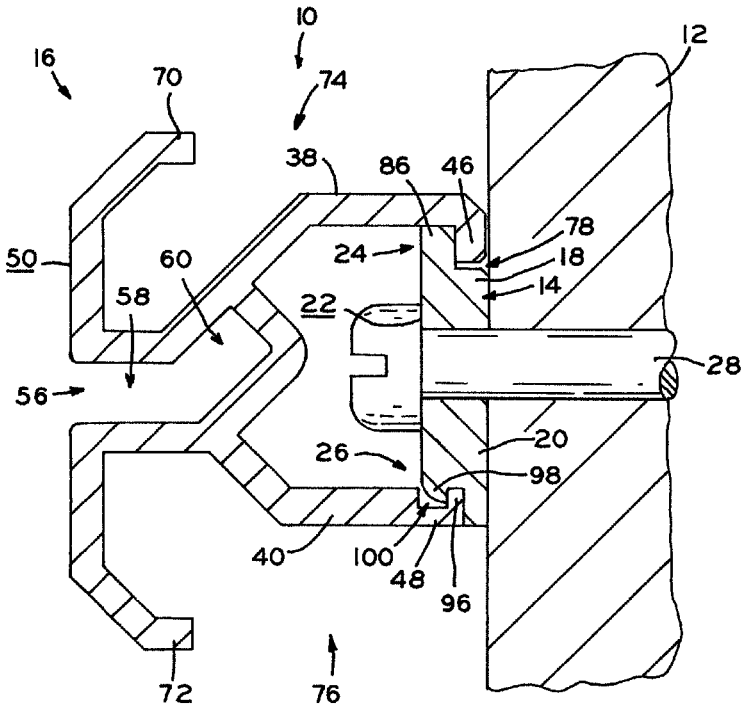
FIG. 2C is an elevation, cross-sectional view of the track of FIG. 2B mounted to the base of FIG. 2A to form the track assembly of FIG. 1.

Turning now to FIG. 2B, track 16 is mountable to base 14 (as shown in FIG. 2C) and includes body 32 having front body portion 34 and rear body portion 36. Rear body portion 36 includes upper arm 38 and lower arm 40 with a plurality of inner angled walls 41, 42, 43, 44 disposed between upper arm 38 and lower arm 40. In an alternative embodiment, the walls disposed between upper and lower arms 38 and 40, respectively, may be perpendicular to, rather than acutely angled with respect to, upper and lower arms 38 and 40. Upper and lower arms 38 and 40 are oriented horizontally and each include respective engagement portions 46 and 48 for engagement with respective upper and lower engagement structures 24 and 26 of base 14. Thus, as described in detail below, upper arm 38 of track 16 is connectable to upper portion 18 of the vertically oriented base 14 and lower arm 40 of track 16 is connectable to lower portion 20 of base 14. When so connected, base 14 and track 16 combine to form track assembly 10.

As shown in FIG. 2C, exterior or front face 50 of front body portion 34 of track 16 substantially covers and restricts access to base 14 when track 16 is mounted to base 14. More particularly, rear body portion 36 of track 16 (i.e., the plurality of inner angled walls 41, 42, 43, 44 and horizontal upper and lower arms 38 and 40, as shown in FIG. 2B) restricts access to exterior face 22 of base 14 when track 16 is mounted to base 14.

Turning back to FIG. 2B, track 16 further includes a first, upper inner horizontal wall 52 and second, lower inner horizontal wall 54 that each extend forward from one or more of the plurality of inner angled walls 41, 42, 43, 44. Walls 41, 42, 43, 52, and 54 together define a relatively narrow channel or slot 56 extending inwardly and generally rearward into front body portion 34 from front face 50 of track 16. Slot 56 includes a horizontally oriented slot section 58 adjacent to front face 50, with slot section 58 formed by horizontal walls 52 and 54. Slot 56 further includes a second, upwardly angled slot section 60 extending rearward from slot section 58, with angled slot section formed by inner angled walls 41 and 42 which are parallel to one another.

Figure 2D:
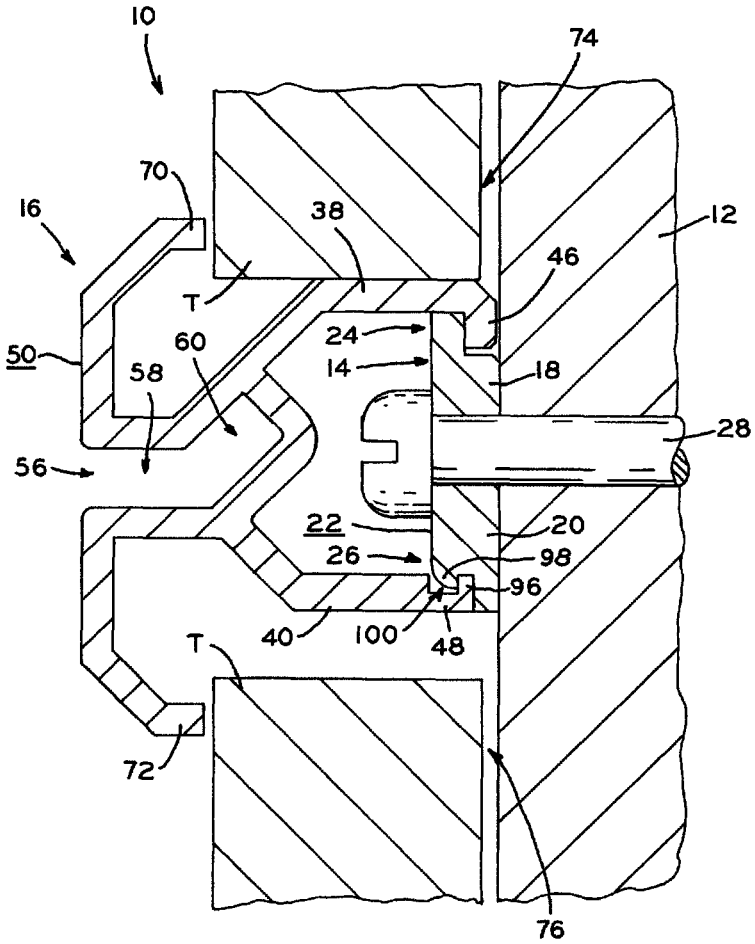
FIG. 2D is an elevation, cross-sectional view of the track assembly of FIG. 2C, in combination with a pair of tiles coupled to the track.
Figure 2E:
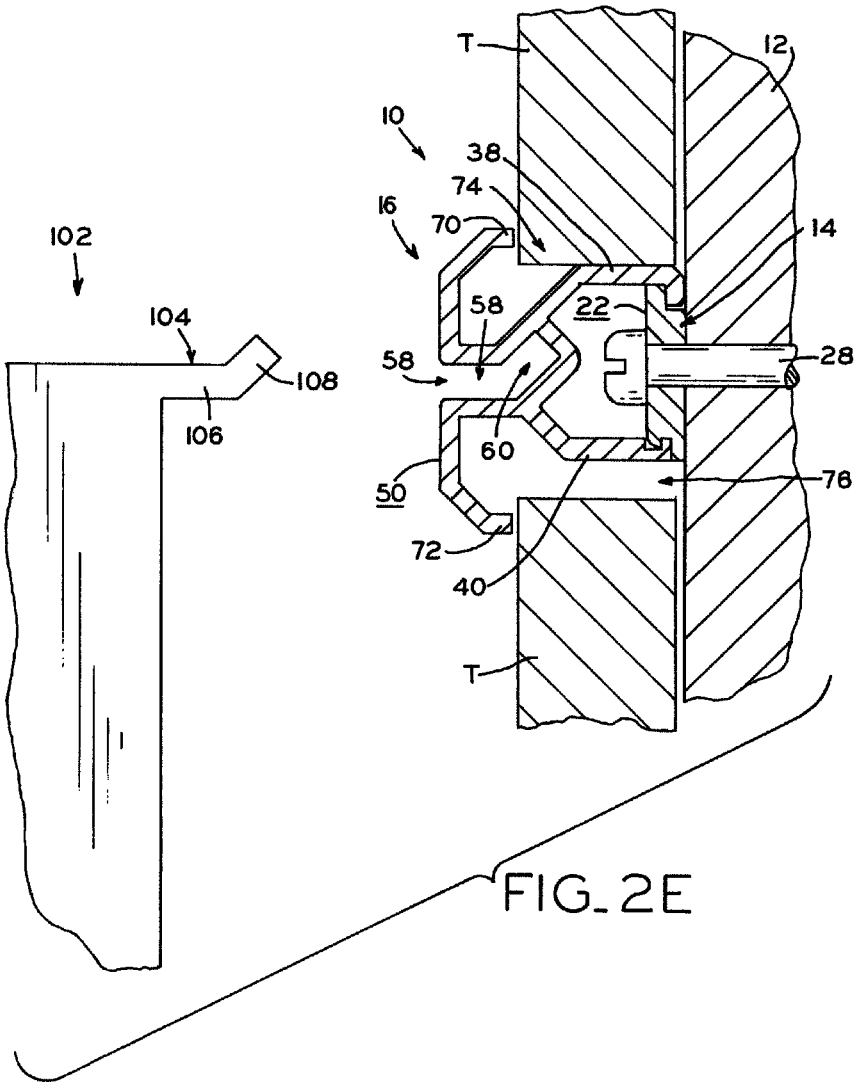
FIG. 2E is an elevation, cross-sectional view of the combination of FIG. 2D, further in combination with an accessory component mountable to the track.

Front body portion 34 of track 16 includes a pair of vertical walls 62 and 64 that extend in opposite directions from slot 56 and cooperate to define front face 50 of track 16. More particularly, each vertical wall 62 and 64 extends from a respective one of the first and second inner horizontal walls 52 and 54, which in turn project forwardly from the plurality of inner angled walls as described above. Front body portion 34 of track 16 additionally includes a pair of outer angled walls 66 and 68 that are angled with respect to substrate 12 and respectively extend rearward from vertical walls 62 and 64. Upper and lower extensions 70 and 72 each extend rearward from a respective one of the pair of the outer angled walls 66 and 68 toward substrate 12. As described below, extensions 70 and 72 may form a pair of tile-receiving horizontal flanges capable of supporting tiles T (FIGS. 1, 2D and 2E).

Figure 6:
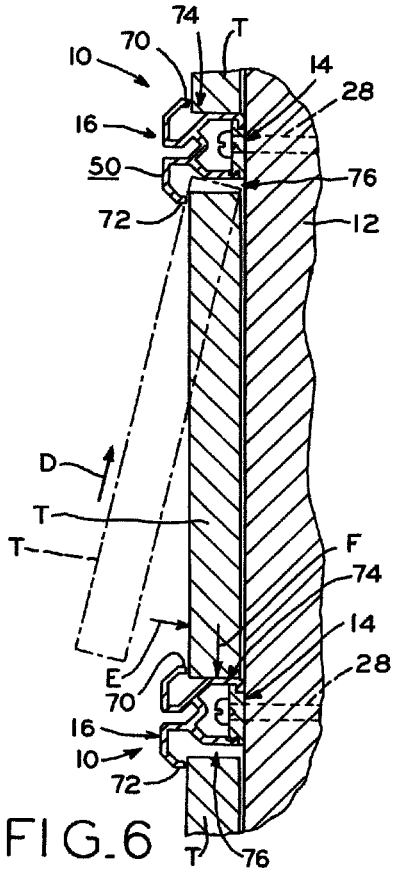
FIG. 6 is an elevation, cross-sectional view of a pair of tracks fastened to a wall in vertically spaced relation, schematically illustrating the mounting of a tile between mutually-facing tile-receiving channels formed in the pair of tracks.

As illustrated FIG. 2C, upper tile-receiving horizontal extension 70 cooperates with upper horizontal arm 38 of track 16 and substrate 12 to define upper tile receiving space 74. Similarly, lower tile-receiving horizontal extension 72 cooperates with lower horizontal arm 40 of track 16 and substrate 12 to define lower tile receiving space 76. A portion of a pair of tiles T are shown received in upper and lower tile receiving spaces 74, 76 in FIG. 2D. The manner in which tiles T are inserted into tile receiving spaces 74 and 76 is illustrated in FIG. 6 and described in detail below.

Upper portion 18 of base 14 includes an upper protrusion 86 (FIG. 2A) defining vertical and horizontal walls 80 and 82. Walls 80 and 82 cooperate with an adjacent surface of substrate 12 to form upper notch 78, which is configured to receive engagement portion 46 of track 16 (FIG. 2B) in a mounting engagement as shown in FIG. 2C. Engagement portion 46 is sized to occupy less than the entire vertical space defined by notch 78, such that upper protrusion 86 abuts a bottom surface of upper arm 38 of track 16 when engagement portion 46 is placed in such mounting engagement with notch 78.

Turning again to FIG. 2A, lower portion 20 of base 14 includes lower intermediate notch 88 defined by a pair of internal vertical walls 90 and 92 and an internal horizontal wall 94. Wall 90 is forward of wall 92, i.e., wall 90 is spaced further away from substrate 12 than is wall 92. Wall 90 is shorter in length compared to wall 92 to facilitate a snap-fit engagement with lower arm 40 as described below. Lower arm 40 of track 16, shown in FIG. 2B, includes second vertical flange 96 that projects upwardly and is sized and configured to be received in lower intermediate notch 88 of base 14. Particularly, lower intermediate notch 88 of base 14 is configured to receive second vertical flange 96 of track 16 to engage track 16 with base 14, as described in detail below.

Lower portion 20 of base 14 further includes lower protrusion 98 (FIG. 2A) adjacent lower intermediate notch 88. Lower notch 100 (FIG. 2B) is formed in lower arm 40 of track 16 adjacent second vertical flange 96, and is configured to receive lower protrusion 98 of base 14 when track 16 is mounted and engaged to base 14 as described below.

Figure 5:
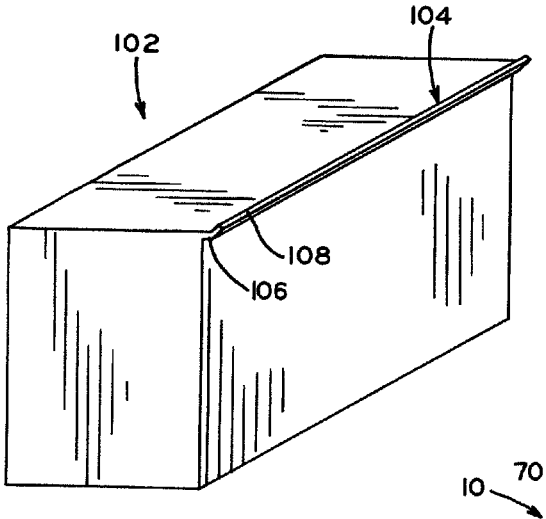
FIG. 5 is a perspective view of a portion of the accessory component of FIG. 1.

Referring to FIGS. 1, 2E and 5, accessory component 102 includes mounting flange 104 sized to be received within slot 56 of track 16, as described in detail below. Mounting flange 104 includes a first, horizontal flange portion 106 and a second, angled flange portion 108. Angled slot section 60 of slot 56 of track 16 is sized and configured to receive angled flange portion 108 of mounting flange 104, while horizontal slot section 58 of slot 56 of track 16 is sized and configured to receive horizontal flange portion 106 of mounting flange 104.

Figure 3A:
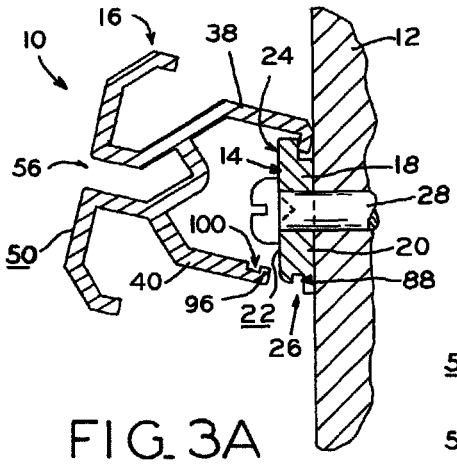
FIG. 3A is a partial elevation, cross-sectional view of the assembly of FIG. 1, in which the base is mounted to a wall and the track is shown being initially mounted to the base, such that an upper arm of a rear body portion of the track engages an upper engagement structure of the base.

The manner and method of mounting track 16 to base 14 is shown in FIGS. 3A-3D and described below. As noted above and shown in FIG. 1, base 14 is first mounted to substrate 12 by one or more fasteners 28, which are inserted through the outwardly facing V-shaped notch 30 formed in front face 22 of base 14. With base 14 securely mounted to substrate 12, upper arm 38 of track 16 is initially engaged with upper portion 18 of base 14 (as shown in FIG. 3A and described below) prior to rotating track 16 downwardly to engage lower arm 40 of track 16 with lower portion 20 of base 14. However, the reverse order may also be possible. For example, it is contemplated that lower arm 40 of track 16 may be initially engaged with lower portion 20 of base 14, such that track 16 is rotated upwardly to engage upper arm 38 of track 16 with upper portion 18 of base 14. Yet another contemplated alternative is for both upper horizontal arm 38 and lower horizontal arm 40 of track 16 to be simultaneously engaged with respective upper and lower portions 18 and 20 of the base 14.

Figure 3B:
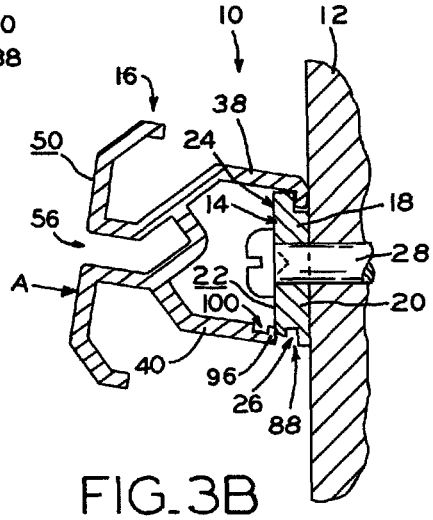
FIG. 3B is a continuation of FIG. 3A, showing the track pivoted about the upper arm to urge a lower arm of the rear body portion of the track towards a lower engagement structure of the base.

Referring back to FIG. 3A, upper horizontal arm 38 of track 16 is shown as being initially engaged with upper portion 18 of base 14 (i.e., by engaging upper engagement portion 46 of track 16 into notch 78 of base 14, as shown in FIG. 2C and described above). Turning to FIG. 3B track 16 is rotated in the direction of arrow A toward base 14 such that lower horizontal arm 40 of track 16 is urged toward lower portion 20 of base 14. As described above and shown in FIG. 2A, lower portion 20 of base 14 has internal vertical wall 90 that is spaced forward of, and shortened with respect to, wall 92. This arrangement allows vertical flange 96 of lower horizontal arm 40 of track 16 to clear protrusion 98 of base 14 as track 16 is rotated along direction A into the final mounted position, as shown between FIGS. 3C and 3D.

Figure 3C:
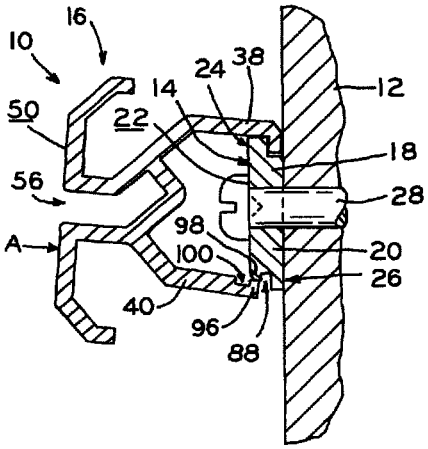
FIG. 3C is a continuation of FIG. 3B, showing the lower arm of the track urged further toward the lower engagement structure of the base.
Figure 3D:
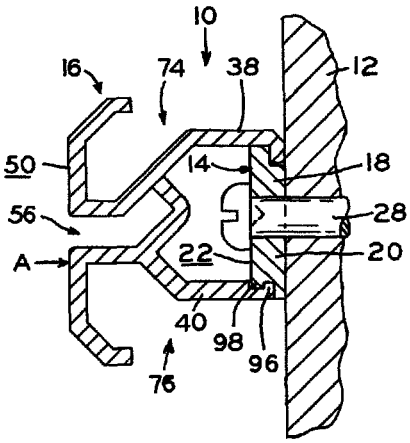
FIG. 3D is a continuation of FIG. 3C, showing the track fully mounted to the base, such that the upper and lower arms of the track are respectively engaged with the upper and lower engagement structures of the base.

When track 16 is in a position of near-final engagement with respect to base 14, as shown in FIG. 3C, lower arm 40 and/or upper arm 38 of track 16 may slightly resiliently deform or bend in order to traverse lower protrusion 98. This resilient material deformation allows arms 38, 40 to "snap" back into their undeformed, parallel and horizontal state, as shown in FIG. 3D, when protrusion 98 is received within lower notch 88 (FIG. 2C) of base 14.

Track 16 is fully mounted to base 14 when lower horizontal arm 40 is fully engaged with lower portion 20 of base 14. More particularly, second vertical flange 96 of lower horizontal arm 40 of track 16 is received in snap-fit engagement within lower intermediate notch 88 of lower portion 20 of base 14, and lower protrusion 98 of lower portion 20 of base 14 is received within notch 100 of lower horizontal arm 40 of track 16.

Thus, track 16 is pivotally mountable to base 14 such that upper arm 38 of track 16 pivots about upper portion 18 of base 14 until lower arm 40 of track 16 attaches to lower portion 20 of base 14 in a snap-fit connection. When track 16 is mounted to base 14, front face 50 of track 16 substantially covers front face 22 of base 14 and thereby hides fasteners 28 from view.

Figure 4B:
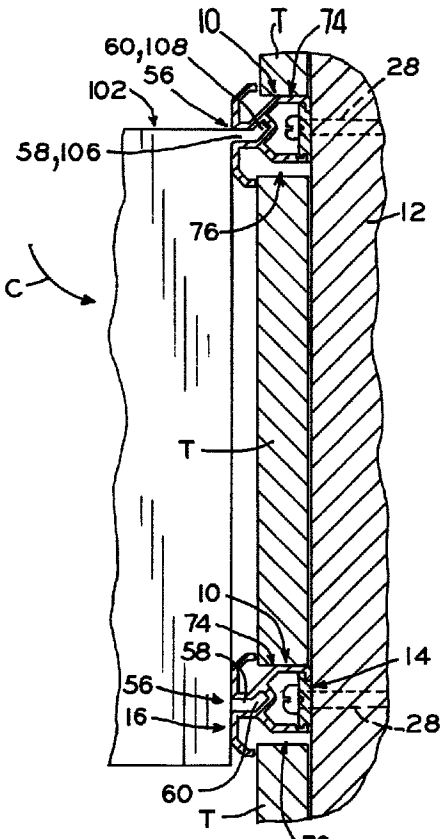
FIG. 4B is a continuation of FIG. 4A, showing the accessory component mounted to the track assembly in a mounted position in which a mounting flange of the accessory component is fully seated within a slot of the track of the track assembly, and the accessory component is disposed in a vertical upright position.
Figure 4A:
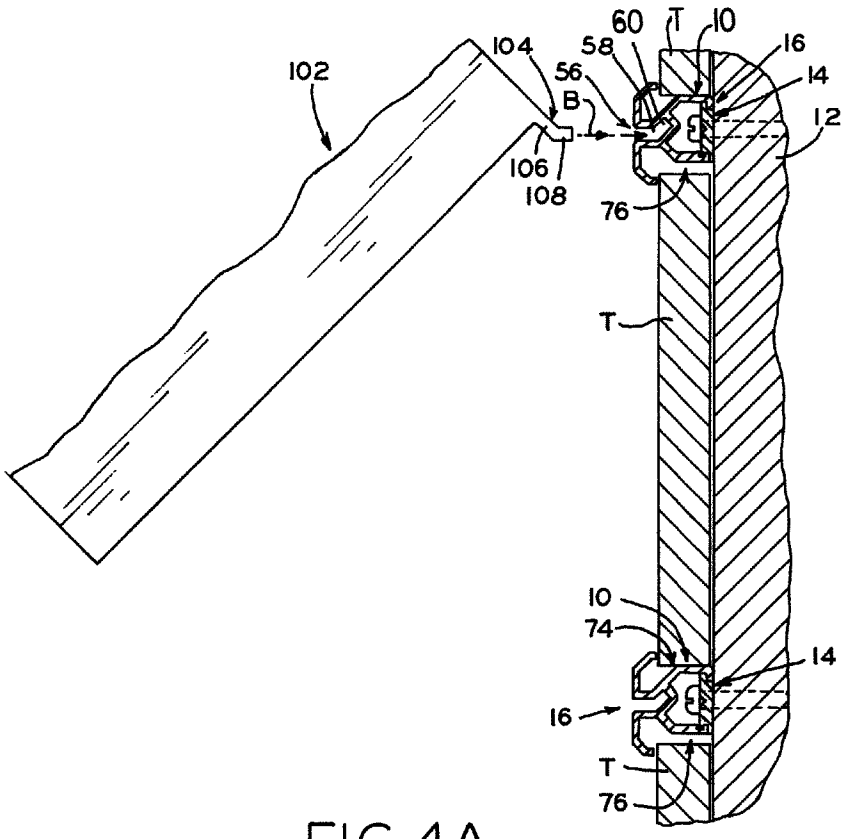
FIG. 4A is an elevation, cross-sectional view of the assembly of FIG. 1, in which the accessory component is shown in a pre-mounting position in which the accessory component is angled with respect to the track assembly.

Turning now to FIGS. 4A and 4B, an accessory component 102, such as a cabinet as shown in FIGS. 1 and 5, may be mounted to slot 56 of track 16 once track assembly 10 is completed as described above. Accessory component 102 includes mounting flange 104 including horizontal flange portion 106 and angled flange portion 108. Track 16 includes relatively narrow slot 56 having horizontal slot section 58 sized to correspond with horizontal flange portion 106, and angled slot section 60 sized to correspond with angled flange portion 108. Mounting flange 104 is inserted into slot 56 of track 16 by inserting angled flange portion 108 of mounting flange 104 into horizontal slot section 58 of slot 56 of track 16 along a direction of arrow B, as shown in FIG. 4A. Angled flange portion 108 is then slid into a seated position within angled slot section 60 of slot 56 of second component by rotating accessory component 102 in the direction of arrow C, as shown in FIG. 4B. As such rotation occurs, horizontal flange portion 106 of accessory component 102 becomes aligned with and is seated within horizontal slot section 58 of slot 56.

Referring to FIG. 6, tile T is shown inserted into tile receiving spaces 74 and 76 of a pair of two-piece track assemblies 10 mounted to substrate 12. Tiles T, which may be decorative or functional tiles for example, have similar upper and lower edges allowing tiles T to be movably mounted and/or attached to track assemblies 10 in either of at least two configurations (e.g., "right-side-up" or "upside-down"). Such mounting is accomplished by tilting tile T at an angle with respect to vertical, as shown in the dashed lines of FIG. 6, and then inserting an upper edge of tile T into lower tile receiving space 76 of an upper track assembly 10. Tile T is then moved upwardly within tile receiving space 76 along direction D while also pivoting tile T to a vertical position as shown by arrow E. The upper edge of tile T is pushed upwardly into tile receiving space 76 sufficiently to allow a lower edge of tile T to clear upper extension 70 of track 16, thereby providing clearance for the final rotation of tile T into the vertical position. The lower edge of tile T is then advanced downwardly along direction F into upper tile receiving space 74 of a lower track assembly 10. When fully seated within tile receiving space 74, as shown in FIG. 6, the lower edge of tile T rests on upper horizontal arm 38 of track 16 of lower track assembly 10.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A track assembly, comprising:

a first component mounted to a substrate, said first component comprising:

an exterior face;

an upper portion including an upwardly projecting protrusion that at least partially defines an upwardly projecting notch; and a lower portion including a downwardly projecting protrusion that at least partially defines a downwardly projecting notch; and a second component mounted to said first component, said second component comprising:

a body having a front body portion and a rear body portion;

said front body portion including a slot having a first, horizontal slot section extending into said body from a front face of said front body portion and a second, angled slot section extending into said body from said first slot section; and said rear body portion including an upper arm and a lower arm, said upper and lower arms respectively engageable within said upper and lower notches of said first component; and a first vertical tile having a lower edge engaging said upper arm of said second component, said first vertical tile disposed adjacent said substrate.

2. The track assembly of claim 1, wherein said second component substantially covers and prevents access to said exterior face of said first component.

3. The track assembly of claim 1, wherein said second slot section is angled upwardly with respect to said first slot section and extends from an end of said first slot section which is disposed opposite said front face of said front body portion.

4. The track assembly of claim 1, wherein said front body portion of said second component further comprises upper and lower extensions wherein:

said upper extension of said second component, said upper arm of said second component, and said substrate cooperate to define a first tile-receiving space, said first vertical tile disposed within said first tile-receiving space; and said lower extension of said second component, said lower arm of said second component, and said substrate cooperate to define a second tile-receiving space, further comprising a second vertical tile disposed within said second tile-receiving space.

5. The track assembly of claim 1, wherein said substrate is selected from the group consisting of a permanent building wall, a movable office wall, and a movable partition system panel.

6. A method of mounting a track assembly to a vertical substrate of an office system, comprising the steps of:

providing a track assembly comprising a first component and a second component, said first component comprising an exterior face, an upper portion including an upwardly projecting protrusion that at least partially defines an upwardly projecting notch; and a lower portion including a downwardly projecting protrusion that at least partially defines a downwardly projecting notch; and said second component comprising a body having a front body portion and a rear body portion, said front body portion including a slot having a first, horizontal slot section extending into said body from a front face of said front body portion and a second, angled slot section extending into said body from said first slot section, and said rear body portion including an upper arm and a lower arm, said upper and lower arms respectively engageable within said upper and lower notches of said first component;

mounting the first component to the vertical substrate;

pivotally mounting the second component to the first component; and engaging a lower edge of a vertical tile with the upper arm of the second component, the vertical tile disposed adjacent the substrate.

7. The method of claim 6, wherein said mounting step comprises mounting the first component to at least one of a permanent building wall, a movable office wall, and a movable partition system panel.

8. The method of claim 6, wherein said step of pivotally mounting the second component to the first component comprises:

engaging an upper arm of the second component with the upwardly projecting notch of the first component;

pivoting the upper arm about the upper portion of the first component; and engaging a lower arm of the second component with the downwardly projecting notch of the first component during said pivoting step.

9. The method of claim 6, wherein said step of pivotally mounting the second component to the first component comprises:

engaging a lower arm of the second component with the downwardly projecting notch of the first component;

pivoting the lower arm about the lower portion of the first component; and engaging an upper arm of the second component with the upwardly projecting notch of the first component during said pivoting step.

10. The method of claim 6, wherein said step of pivotally mounting the second component to the first component comprises:

engaging an upper arm of the second component with the upwardly projecting notch of the first component; and engaging a lower arm of the second component with the downwardly projecting notch of the first component, such that the upper and lower arms are substantially horizontal when the upper and lower arms are fully engaged with the upper and lower engagement structures respectively.

11. The track assembly of claim 1 further comprising an accessory component comprising a mounting flange including a first, horizontal flange portion and a second, angled flange portion extending from said first flange portion.

12. A track assembly, comprising:

a first component mountable to a substrate, said first component comprising:

an exterior face;

an upper portion including upper engagement structure; and a lower portion including lower engagement structure; and a second component mountable to said first component, said second component comprising:

a body having a front body portion and a rear body portion;

said front body portion including a slot having a first, horizontal slot section extending into said body from a front face of said front body portion and a second, angled slot section extending into said body from said first slot section, said angled slot section being angled at a non-perpendicular angle to said first slot section; and said rear body portion including an upper arm and a lower arm, said upper and lower arms respectively engageable with said upper and lower engagement structures of said first component; and said front body portion of said second component further comprising upper and lower extensions extending upwardly and downwardly a distance beyond said upper and lower arms, respectively, wherein, when said second component is mounted to said first component and said first component is mounted to said substrate, said upper and lower extensions of said second component, said respective upper and lower arms of said second component, and said substrate cooperate to define a pair of tile-receiving spaces.

13. The track assembly of claim 12 further comprising an accessory component comprising a mounting flange including a first, horizontal flange portion and a second, angled flange portion extending from said first flange portion.

14. The track assembly of claim 4, wherein said upper and lower extensions of said front body portion extend upwardly and downwardly a distance beyond said upper and lower arms, respectively, to defined said first and second tile-receiving spaces.

15. The track assembly of claim 14, wherein at least one of said upper and lower extensions of said front body portion includes a vertical wall and an angled wall extending rearwardly from an end of said vertical wall toward said first component.

16. The track assembly of claim 15, wherein each of said upper and lower extensions of said front body portion includes a vertical wall and an angled wall extending rearwardly from an end of said vertical wall toward said first component, said angled walls respectively engageable with tiles received within said tile-receiving spaces.

17. The track assembly of claim 12, wherein said upper engagement structure includes an upwardly projecting protrusion that at least partially defines an upwardly projecting notch and said lower engagement structure includes a downwardly projecting protrusion that at least partially defines a downwardly projecting notch, said upper and lower arms respectively engageable within said upper and lower notches.

18. The track assembly of claim 17, wherein at least one of said upper and lower extensions of said front body portion includes a vertical wall and an angled wall extending rearwardly from an end of said vertical wall toward said first component.

19. The track assembly of claim 18, wherein each of said upper and lower extensions of said front body portion includes a vertical wall and an angled wall extending rearwardly from an end of said vertical wall toward said first component, said angled walls respectively engageable with tiles received within said tile-receiving spaces.

20. The track assembly of claim 12, wherein when said second component is mounted to said first component, said second component substantially covers and prevents access to said exterior face of said first component.

21. The track assembly of claim 1, wherein said first component has a width extending along a horizontal direction and a height extending along a vertical direction, said width significantly greater than said height.

22. The track assembly of claim 1, further comprising an additional track assembly mounted to the substrate and disposed above said track assembly, said first vertical tile disposed between, and retained adjacent to the substrate by, said track assembly and said additional track assembly.

23. The track assembly of claim 12, wherein said first component is mounted to the substrate and said second component is mounted to said first component, further comprising a first vertical tile having a lower edge engaging said upper arm of said second component, said first vertical tile disposed adjacent the substrate.

24. The track assembly of claim 22, further comprising an additional track assembly mounted to the substrate and disposed above said track assembly, said first vertical tile disposed between, and retained adjacent to the substrate by, said track assembly and said additional track assembly.

* * * * *